US008283045B2

(12) United States Patent
Stoelting

(10) Patent No.: US 8,283,045 B2
(45) Date of Patent: Oct. 9, 2012

(54) AWARD FOR SPORTING EVENT

(76) Inventor: Scott Stoelting, Lawrenceburg, IN (US)

( * ) Notice: Subject to any disclaimer, the term of this patent is extended or adjusted under 35 U.S.C. 154(b) by 0 days.

(21) Appl. No.: 13/036,863

(22) Filed: Feb. 28, 2011

(65) Prior Publication Data

US 2011/0217563 A1 Sep. 8, 2011

Related U.S. Application Data

(60) Provisional application No. 61/310,444, filed on Mar. 4, 2010.

(51) Int. Cl.
*A47G 35/00* (2006.01)
*A63B 57/00* (2006.01)
*B65D 85/08* (2006.01)

(52) U.S. Cl. ..... 428/542.4; 428/542.2; 248/176.1; 150/160

(58) Field of Classification Search ..... 428/7, 8, 428/9, 11, 12, 16, 542.2, 542.4; 150/160
See application file for complete search history.

(56) References Cited

U.S. PATENT DOCUMENTS

D174,195 S * 3/1955 Reising ..... D11/157
3,473,247 A * 10/1969 La Favor et al. ..... 40/538
D255,239 S * 6/1980 Thomas ..... D14/143
4,368,768 A * 1/1983 Cunko, Jr. ..... 150/160
4,444,371 A * 4/1984 Ragen ..... 248/226.11
D275,744 S * 10/1984 McJunkin et al. ..... D11/157
D279,556 S * 7/1985 McJunkin ..... D11/133
D279,557 S * 7/1985 McJunkin ..... D11/157
4,984,684 A * 1/1991 Conner et al. ..... 206/315.3
D321,844 S * 11/1991 Nys ..... D11/157
5,246,108 A * 9/1993 Nusbaum ..... 206/315.2
5,322,739 A 6/1994 Stagl
5,443,156 A * 8/1995 Shioda ..... 206/315.4
5,586,674 A * 12/1996 Nachbauer ..... 206/315.4
5,698,334 A * 12/1997 Berens ..... 428/542.4
6,230,886 B1 5/2001 Bradshaw
D447,720 S * 9/2001 Beller ..... D11/157
6,828,034 B2 12/2004 Banman
D538,707 S * 3/2007 Park ..... D11/157
2007/0039216 A1 2/2007 Scarpitti
2008/0051207 A1* 2/2008 Leslie ..... 473/196
2009/0084008 A1* 4/2009 Middleton et al. ..... 40/430

* cited by examiner

*Primary Examiner* — Aaron Austin

(74) *Attorney, Agent, or Firm* — Jenei LLC

(57) ABSTRACT

The present invention is an award that serves as a trophy and as a golf club head cover. The cover of the award is positioned on a stand that is supported by a base or positioned on a golf club head as a golf club head cover.

12 Claims, 4 Drawing Sheets

Figure 3
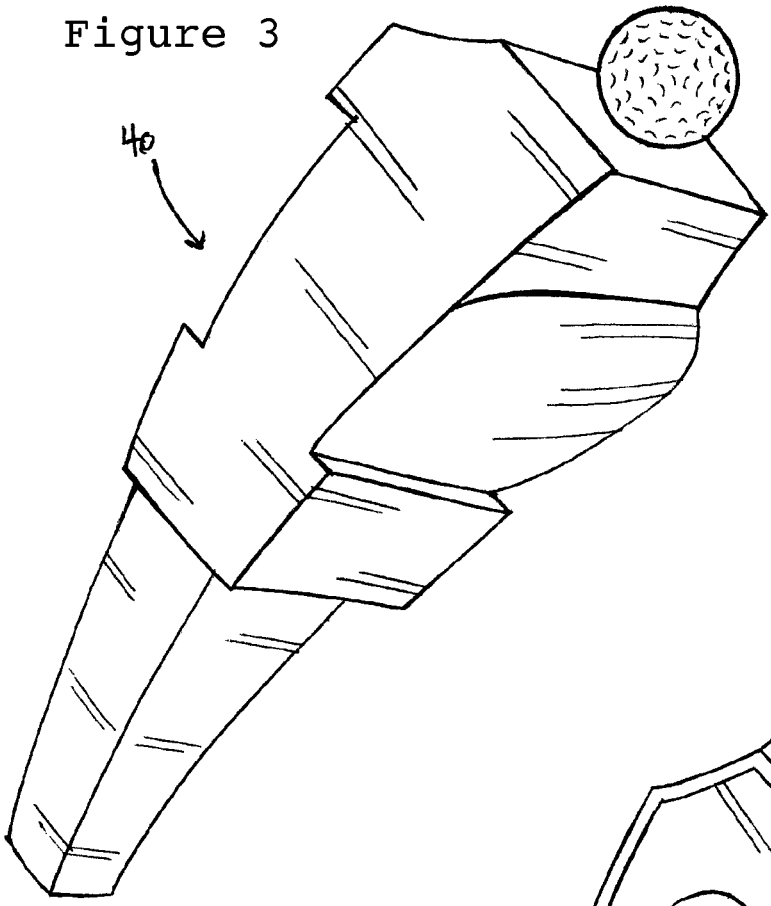
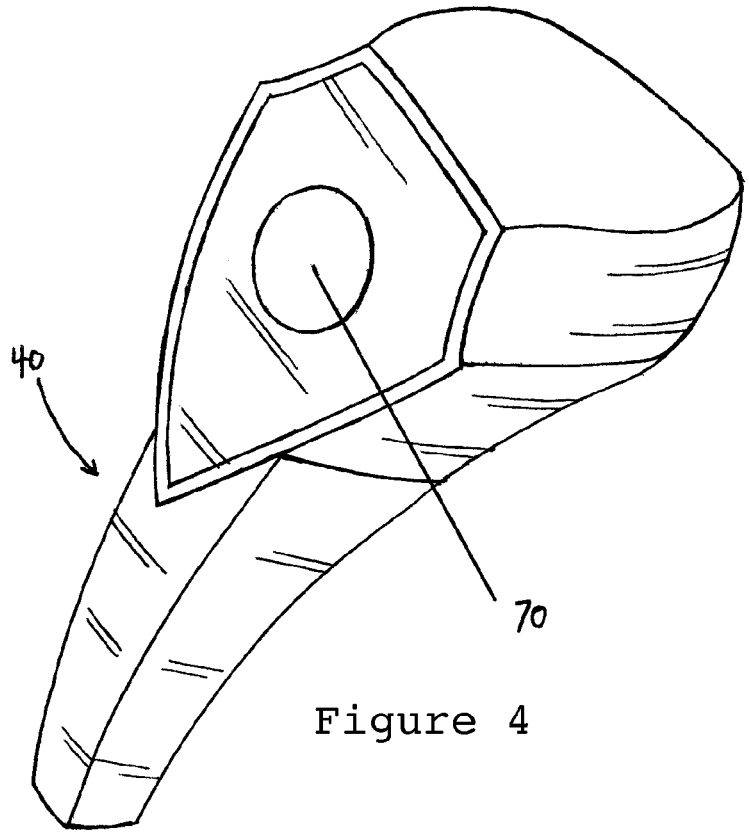
Figure 4

AWARD FOR SPORTING EVENT

CROSS-REFERENCE TO RELATED APPLICATION

The present application claims priority to U.S. Provisional Patent Application No. 61/310,444 as filed Mar. 4, 2010.

STATEMENT REGARDING FEDERALLY SPONSORED RESEARCH

Not applicable.

NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND ON THE INVENTION

1. Field of the Invention

The present invention relates generally to an award, and more particularly the present invention relates to award that can be displayed or function as a golf club head cover.

2. Description of the Related Art

Achievement awards of various types are frequently given to individuals and athletic teams for outstanding achievements in sports such as golf, bowling, tennis, baseball, basketball and the like. These awards include medals, plaques and a number of different types of small statues of which frequently take the form of a decorative member of an appropriate design that is mounted on a supporting base.

A trophy construction comprising an injection molded figurine, a supporting base and a decorative riser column that extends between the supporting base and the figurine, for example, is a popular trophy construction and is well known in the art.

The base of the figurine includes an outwardly extending threaded stud that is typically molded into the base of the figurine during the molding process. This trophy construction often includes an elongated connector rod having a first threaded end that can be connected to the threaded stud by means of an internally threaded coupler. The rod extends through the decorative riser and includes a second threaded end that protrudes into a cavity formed in the supporting base. A nut, which is threadably received over the second end of the rod, functions to interconnect the supporting base and the decorative riser. U.S. Pat. No. 5,322,739 to Stagl discloses a trophy construction of a somewhat similar configuration.

Golf club head covers have been used for many years to protect golf club heads from marring and scratching when they are carried in a golf bag. The head covers can be made of a soft, padded, bulky material, yet several constructions are known in the art. Typical head covers can extend around the golf club head and a portion of a shaft attached thereto, and they are typically closed at an upper end and open at a lower end. Head covers may include an opening that is relatively wide to allow ease in applying the head cover to and removing the head cover from the golf club head, while other head covers may include a smaller opening such that the opening can be stretched or further opened to easily apply the head cover to and remove the head cover from the golf club head.

What is desired is an award presented in the form of a golf club head cover. More particularly, what is desired is such an award that can function as a golf club head cover for an individual's clubs while representing an individual's achievements or displayed in an off-course setting as a trophy.

SUMMARY

Various exemplary embodiments of the present invention include an award for a sporting event. The award is comprised of a base and a stand. The stand extends upwardly from and is substantially supported by the base. The award is further comprised of a cover. The cover is adapted to substantially encase a golf club head, and the cover is positioned on the stand.

Various exemplary embodiments of the present invention further include an award for a sporting event. The award is comprised of a cover, wherein the cover is adapted to substantially encase a golf club head.

Various exemplary embodiments of the present invention also include a method for displaying an award for a sporting event. The method for displaying an award is comprised of the steps of presenting an award for a sporting event to a winner of the sporting event. The award comprises a cover, wherein the cover is adapted to substantially encase a golf club head. The method for displaying an award is further comprised of the steps of positioning the award on a display means.

BRIEF DESCRIPTION OF THE DRAWINGS

The various exemplary embodiments of the present invention, which will become more apparent as the description proceeds, are described in the following detailed description in conjunction with the accompanying drawings, in which:

FIG. 3 is an illustrated perspective view of a cover of an exemplary embodiment of the present invention.

FIG. 4 is another illustrated perspective view of a cover of an exemplary embodiment of the present invention.

DESCRIPTION OF THE REFERENCED NUMERALS

Figure 1:
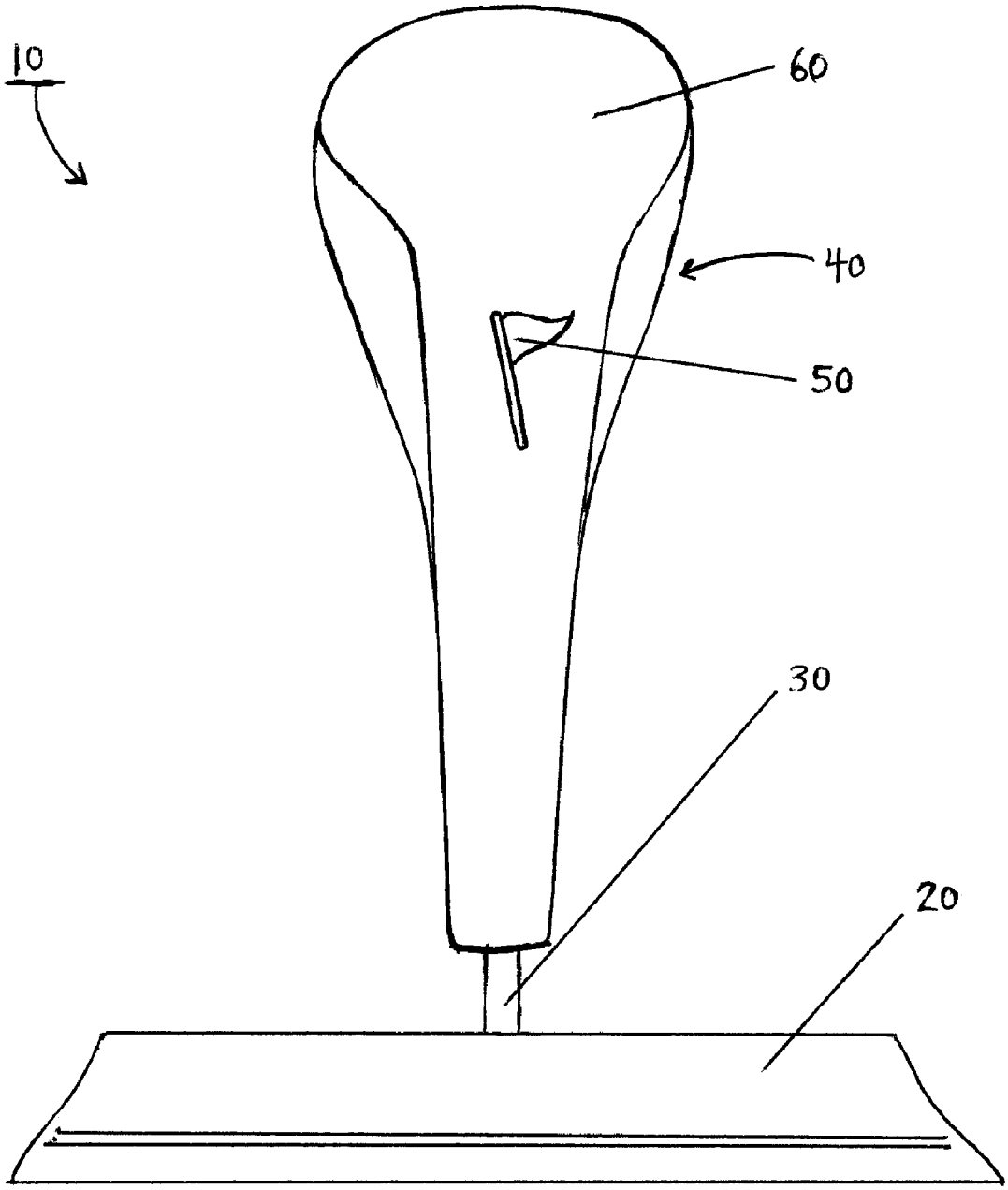
FIG. 1 is an illustrated front view of an exemplary embodiment of the present invention.

In reference to the drawings, similar reference characters denote similar elements throughout all the drawings. The following is a list of the reference characters and associated element:

10 award for a sporting event
20 base
30 stand
40 cover
50 pin
60 top of the cover
70 medallion

DETAILED DESCRIPTION

FIG. 1 relates to an award for a sporting event 10. The award comprises a base 20 and a stand 30. The stand extends upwardly from and is substantially supported by the base. The award further comprises a cover 40, wherein the cover is adapted to substantially encase a golf club head. In a preferred embodiment of the present invention, an interior of the cover is substantially shaped as a golf club head.

Figure 2:
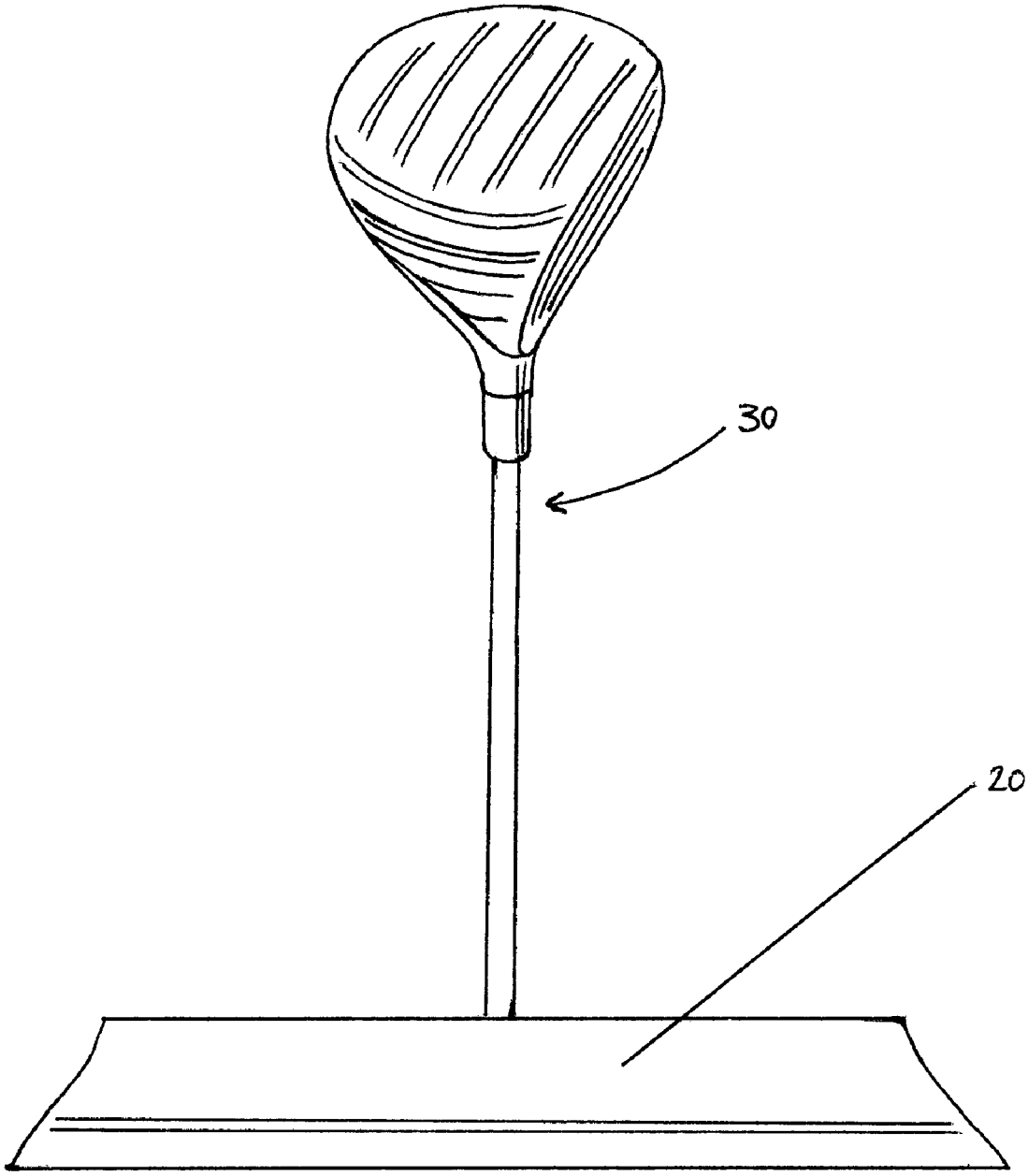
FIG. 2 is an illustrated front view of an exemplary embodiment of the present invention without a cover.

In a preferred embodiment of the present invention, and as displayed in FIG. 2, the stand is substantially shaped as a golf club head. In an exemplary embodiment of the present invention, and as shown in FIG. 1, the cover is positioned on the stand to be displayed as a trophy. In an exemplary embodiment of the present invention, the stand identifies an achievement, an event, a sponsor, an individual, or a combination thereof such that the stand and the base can be displayed as a trophy in an absence of the cover. In an exemplary embodiment of the present invention, the cover is positioned on a golf club head to serve as a golf club cover and to display an individual's achievements. In a preferred embodiment of the present invention, the cover may be used in either fashion, on or off the course.

In an exemplary embodiment of the present invention, the cover may be adorned with one or more pins 50 as shown in FIG. 1. In an exemplary embodiment of the present invention, the cover provides open spaces, such as the top of the cover 60, to accommodate one or more signatures or autographs. In an exemplary embodiment of the present invention, the cover may hold one or more medallion 70 as displayed in FIG. 4. In an exemplary embodiment of the present invention, the cover may include one or more medallions, pins, embroideries, printed items, spaces for signatures or a combination thereof. In a preferred embodiment of the present invention, the cover identifies an achievement, an event, a sponsor, an individual, or a combination thereof.

FIGS. 3 and 4 display exemplary embodiments of the present invention. FIG. 3, for example, displays the cover of the present invention taking the form of the number one. FIG. 4, for example, displays a crest or shield with a medallion. In other embodiments of the present invention, the cover of the present invention may also be substantially shaped as a flag, a golf tee, a trophy cup, or the like. However, embodiments of the present invention are not limited to exemplary shapes disclosed herein.

Figure 5:
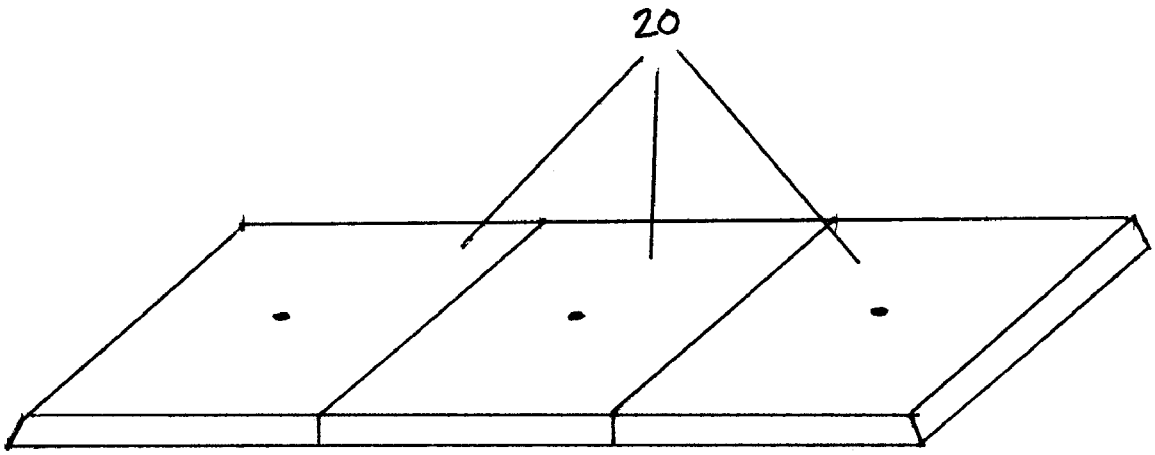
FIG. 5 is an illustrated perspective view of bases of exemplary embodiments of the present invention.

The base supports the stand, as well as the cover, when positioned on the stand. As shown in FIGS. 1 and 5, the base may have a traditional geometric shape. In exemplary embodiments of the present invention, an engraved plaque, plate, scorecard holder, and/or the like (not shown) may be positioned on the base, for example, to specify a recipient or a particular achievement. In exemplary embodiments of the present invention, the base is substantially shaped as a putting green (not shown). In such exemplary embodiments of the present invention, the base is further comprised of bleachers (not shown), wherein the bleachers are positioned substantially around the stand.

As shown in FIG. 5, in an exemplary embodiment of the present invention, the base may connect with one or more bases to display multiple awards. In this embodiment, the awards are connected to form a display rack. In an exemplary embodiment, the award is further comprised of a protective outer case (not shown), wherein the protective outer case is positioned over the stand and the cover and substantially connects to the base.

The present invention also relates to a method for displaying an award for a sporting event. The method comprises the steps of presenting the award for a sporting event of the present invention to a winner of the sporting event. The method further comprises the steps of positioning the award on a display means. In an exemplary embodiment of the present invention, the display means is the golf club head. In another exemplary embodiment of the present invention, the display means is the stand.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. An award for sporting event comprising:

a base;

a stand consisting essentially of a partial golf club having (a) a golf club head and (b) a portion of a golf club shaft having a first and second end; and a removable golf club head cover having a first end, a second end and an interior;

wherein the stand extends upwardly from and is substantially supported by the base;

wherein the removable cover is closed at the first end and open at the second end and the interior of the cover is substantially shaped as a golf club head and wherein the first end of the golf club shaft physically contacts to or connects with the base and the second end connects with the golf club head to form a partial golf club that can accept the removable golf club head cover over the golf club head of the stand; and wherein the cover is capable of being positioned on the stand to substantially encase the golf club head.

2. An award according to claim 1, wherein he base is substantially shaped as a putting green.

3. An award according to claim 2, wherein the base is further comprised of bleachers, wherein the bleachers are positioned substantially around the stand.

4. An award according to claim 1, wherein the base physically contacts to or connects with one or more bases to display multiple awards.

5. An award according to claim 1, wherein the award is further comprised of a protective outer case, wherein the protective outer case is positioned over the stand and the cover and substantially connects to the base.

6. An award according to claim 1, wherein one or more medallions, pins, embroideries, printed items, spaces for signatures, or a combination thereof may be attached to the cover, and wherein one or more engraved plaques, plates, scorecard holders, or a combination thereof are positioned on the base.

7. A method for displaying an award for a sporting event, the method comprising the steps of: presenting an award for a sporting event to a winner of the sporting event, wherein the award comprises an award for a sporting event according to claim 1.

8. A method for displaying an award according to claim 7, wherein the base is substantially shaped as a putting green.

9. A method for displaying an award according to claim 8, wherein the base is further comprised of bleachers, wherein the bleachers are positioned substantially around the stand.

10. A method for displaying an award according to claim 7, wherein the base physically contact to or connects with one or more bases to display multiple awards.

11. A method for displaying an award according to claim 7, wherein the award is further comprised of a protective outer case, wherein the protective outer case is positioned over the stand and the cover and substantially connects to the base.

12. A method for displaying an award according to claim 7, wherein one or more medallions, pins, embroideries, printed items, spaces for signatures, or a combination thereof may be attached to the cover, and wherein one or more engraved plaques, plates, scorecard holders, or a combination thereof are positioned on the base.

* * * * *